US011258200B2

(12) United States Patent
Ohfuku et al.

(10) Patent No.: US 11,258,200 B2
(45) Date of Patent: Feb. 22, 2022

(54) CONNECTOR AND CONNECTOR UNIT

(71) Applicant: YAZAKI CORPORATION, Tokyo (JP)

(72) Inventors: Ryosuke Ohfuku, Makinohara (JP); Akihiro Tsuruta, Fujieda (JP); Takahiro Ohmoto, Wako (JP); Masaru Shinmura, Wako (JP); Yu Saito, Wako (JP); Yuki Goto, Wako (JP); Takashi Endo, Wako (JP); Kazuyuki Iwashita, Wako (JP); Kazuhide Ikeya, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 54 days.

(21) Appl. No.: 16/804,002

(22) Filed: Feb. 28, 2020

(65) Prior Publication Data

US 2020/0203888 A1 Jun. 25, 2020

Related U.S. Application Data

(63) Continuation of application No. PCT/JP2018/032318, filed on Aug. 31, 2018.

(30) Foreign Application Priority Data

Aug. 31, 2017 (JP) ..... JP2017-167967

(51) Int. Cl.
*H01R 13/627* (2006.01)
*H01R 13/436* (2006.01)

(52) U.S. Cl.
CPC ..... *H01R 13/6273* (2013.01); *H01R 13/4362* (2013.01)

(58) Field of Classification Search
CPC ..... H01R 13/6272; H01R 13/6275; H01R 13/465; H01R 13/641; H01R 13/6273; H01R 13/4362
USPC ..... 439/352, 357, 358, 488, 489
See application file for complete search history.

(56) References Cited

U.S. PATENT DOCUMENTS 5,720,623 A * 2/1998 Polenick ..... H01R 13/641 439/352
6,261,115 B1 * 7/2001 Pederson ..... H01R 13/6272 439/352
6,435,895 B1 * 8/2002 Fink ..... H01R 13/6272 439/352
6,712,635 B1 * 3/2004 Nimura ..... H01R 13/6272 439/352

(Continued)

FOREIGN PATENT DOCUMENTS

JP 2012-64461 A 3/2012

*Primary Examiner* — Thanh Tam T Le
(74) *Attorney, Agent, or Firm* — Kenealy Vaidya LLP

(57) ABSTRACT

A connector includes a first housing, a second housing and a fitting assuring member. The second housing includes a first locking protrusion portion having a first slope. The fitting assuring member includes a first assuring locking portion that gets over the first locking protrusion portion to be thereby locked to the first locking protrusion portion when the first housing and the second housing are fitted to each other. The first assuring locking portion begins to slide on the first slope before completion of the fitting, and stays on the first slope until the completion of the fitting.

7 Claims, 23 Drawing Sheets

(56) References Cited

U.S. PATENT DOCUMENTS 6,908,329 B2 * 6/2005 Kozono ..... H01R 13/641 439/352
6,918,783 B2 * 7/2005 Endo ..... H01R 13/6272 439/352
7,101,213 B2 * 9/2006 Toyoda ..... H01R 13/6272 439/358
7,114,983 B2 * 10/2006 Fukatsu ..... H01R 13/4223 439/358
7,252,530 B2 * 8/2007 Shamoto ..... H01R 13/641 439/352
7,402,069 B2 * 7/2008 Shigeta ..... H01R 13/641 439/352
7,559,787 B2 * 7/2009 Shigeta ..... H01R 13/6272 439/358
7,722,385 B2 * 5/2010 Nakamura ..... H01R 13/6272 439/489
7,909,638 B2 * 3/2011 Seo ..... H01R 13/6272 439/489
7,980,887 B2 * 7/2011 Urano ..... H01R 13/639 439/489
8,016,606 B1 * 9/2011 Kwan ..... H01R 13/641 439/352
8,616,914 B2 * 12/2013 Mumper ..... H01R 13/6272 439/489
8,678,846 B2 * 3/2014 Hitchcock ..... H01R 13/641 439/352
8,747,146 B2 * 6/2014 Brown ..... H01R 13/639 439/489
8,882,528 B2 * 11/2014 Sasho ..... H01R 13/6335 439/358
8,920,187 B2 * 12/2014 Kon ..... H01R 13/6272 439/354
9,142,919 B2 * 9/2015 Osada ..... H01R 13/642
9,425,534 B2 * 8/2016 Schmidt ..... H01R 13/6272
9,431,777 B2 * 8/2016 Horiuchi ..... H01R 13/6272
9,490,576 B2 * 11/2016 Plazio ..... H01R 13/641
9,666,989 B2 * 5/2017 Horiuchi ..... H01R 13/641
9,705,253 B2 * 7/2017 Horiuchi ..... H01R 13/641
9,929,509 B1 * 3/2018 Penn ..... H01R 13/641
2013/0210266 A1 8/2013 Osada et al.

* cited by examiner

CONNECTOR AND CONNECTOR UNIT

CROSS-REFERENCE TO RELATED APPLICATIONS

This is a continuation of International Application No. PCT/JP2018/032318 filed on Aug. 31, 2018, and claims priority from Japanese Patent Application No. 2017-167967 filed on Aug. 31, 2017, the entire content of which is incorporated herein by reference.

BACKGROUND

The present invention relates to a connector and a connector unit.

In a connector formed by a pair of housings fitted to each other, one of the housings is inserted up to a fitting position of the other housing so that terminals received in the housings are electrically connected to each other and the housings are locked to each other. However, the fitting work is performed manually on such a connector. Therefore, there is a fear of terminating the fitting work without noticing a half-fitted (non-locked) state in which one of the housings has not been inserted to a regular fitting position, so that the housing may be unlocked later.

In order to prevent such a half-fitted state between housings, a connector provided with a fitting position assuring lock has been proposed.

The connector according to Patent Literature 1 has a cylindrical female housing in which a female terminal has been received, a cylindrical male housing in which a male terminal has been received and which is fitted to the female housing, a cylindrical fitting assuring member which is slidably attached to the outside of the female housing, a female lock which is supported like a cantilever on the female housing so as to extend toward the male housing, a fitting assuring lock which is supported like a cantilever on the fitting assuring member so as to extend toward the male housing, and a locking protrusion which protrudes from an external surface of the male housing so as to lock the female lock and the fitting assuring lock. The locking protrusion has a slope on which a locking portion on the front end side of the female lock and a locking claw on the front end side of the fitting assuring lock can ride.

In this configuration, when the male housing is inserted into the female housing to which the fitting assuring member has been attached, the locking portion of the female lock first gets over the slope of the locking protrusion so as to be locked to the locking protrusion. Successively, the locking claw of the fitting assuring lock gets over the slope of the locking protrusion and the locking portion of the female lock so as to be locked to the locking protrusion through the locking portion of the female lock. The fitting assuring lock is thus locked to the locking protrusion through the female lock so that fitting between the housings can be assured.

As for details of the above protector, refer to JP-A-2012-064461.

SUMMARY

According to Patent Literature 1, in the fitting process between the housings, the locking portion of the female lock and the locking claw of the fitting assuring lock slide on the slope of the locking protrusion sequentially to be thereby elastically deformed. Therefore, when the locking portion of the female lock is sliding on the slope, a component of reaction received from the slope by the female lock acts on the female housing as a repulsive force against the fitting in the connector so that the female housing can be pushed back if a worker suspends the fitting work. On the other hand, when the locking claw of the fitting assuring lock is sliding on the slope, a component of reaction received from the slope by the fitting assuring lock acts on the fitting assuring member as a repulsive force against the fitting in the connector so that the female housing can be pushed back through the fitting assuring member if the worker suspends the fitting work. The worker feeling such a repulsive force can recognize the half-fitted state.

Here, the top face of the locking protrusion may be formed into a flat face substantially parallel to the fitting direction, for example, in order to suppress the maximum displacement of the female lock to thereby miniaturize the connector as a whole. In this case, when the fitting assuring lock rides on the top face of the locking protrusion before the female lock is locked to the locking protrusion, no repulsive force acts for a period from when the fitting assuring lock rides on the top face to when the fitting is set in the connector. As a result, it is likely that the worker cannot recognize the half-fitted state. Particularly if the repulsive force having acted till then disappears immediately before the fitting, the worker who erroneously recognize that the connector has reached a fitted state may terminate the fitting work in spite of the half-fitted state.

Therefore, an object of the present invention is to provide a connector and a connector unit capable of surely making a repulsive force act until just before fitting.

Embodiments of a connector and a connector unit according to the present invention provide the following item (1) to (7).

(1) A connector comprising:

a first housing;

a second housing fitted to the first housing; and a fitting assuring member slidably attached to an outside of the first housing, the second housing including a first locking protrusion portion having a first slope, the fitting assuring member including a first assuring locking portion sliding on the first slope to be elastically deformed in accordance with relative movement to the second housing, the first assuring locking portion being configured to slide and move relatively to the first housing to get over the first locking protrusion portion and be elastically restored to be locked to the first locking protrusion upon the first housing and the second housing being fitted to each other, the first assuring locking portion beginning to slide on the first slope before completion of the fitting between the first housing and the second housing, the first assuring locking portion staying on the first slope until the completion of the fitting between the first housing and the second housing.

According to a first aspect of the invention, relating to the item (1), the first assuring locking portion begins to slide on the first slope before the first housing and the second housing are fitted to each other, and stays on the first slope until the first housing and the second housing are fitted to each other. The first assuring locking portion on the first slope suffers reaction from the first slope, and a component of the reaction acts on the fitting assuring member as a repulsive force against the fitting in the connector. Accordingly, the repulsive force derived from the first assuring locking portion can be made to act until just before the fitting, so that half-fitting can be prevented.

(2) The connector according to the item (1), wherein the first housing includes a connector locking portion sliding on the first slope to be elastically deformed in accordance with relative movement to the second housing, the connector locking portion is configured to get over the first locking protrusion portion and be elastically restored to be locked to the first locking protrusion portion, the first housing and the second housing are brought into a connector fitting state in which the first housing and the second housing are completely fitted to each other when the connector locking portion is locked to the first locking protrusion portion, the first assuring locking portion begins to slide on the first slope while the connector locking portion stays on the first slope, and in the connector fitting state the first assuring locking portion gets over the first locking protrusion portion and the connector locking portion and is elastically restored and locked to the connector locking portion locked to the first locking protrusion portion.

According to a second aspect of the invention, relating to the item (2), the connector locking portion on the first slope suffers reaction from the first slope, and a component of the reaction acts on the first housing as a repulsive force against the fitting in the connector. Accordingly, when the top face of the first locking protrusion portion is, for example, a flat face substantially parallel to the fitting direction, the repulsive force derived from the connector locking portion acts in, of the whole region of a fitting stroke from when the connector locking portion begins to slide on the first slope until the connector locking portion is locked to the first locking protrusion portion, the first half until the first assuring locking portion begins to slide on the first slope, and the repulsive force derived from the first connector locking portion and the repulsive force derived from the first assuring locking portion act in the second half from when the first assuring locking portion begins to slide on the first slope until the connector locking portion rides on the top face of the first locking protrusion portion. Further, the repulsive force derived from the first assuring locking portion acts just before the fitting from when the connector locking portion rides on the top face of the first locking protrusion portion until the connector locking portion is locked to the first locking protrusion portion. That is, some repulsive force can be made to act all over the fitting stroke.

(3) The connector according to the item (2), wherein the second housing includes a second locking protrusion portion in a different position from the first locking protrusion portion, the second locking protrusion portion has a second slope, the fitting assuring member includes a second assuring locking portion sliding on the second slope to be elastically deformed in accordance with relative movement to the second housing, the second assuring locking portion is configured to slide and move relatively to the first housing in the connector fitting state to get over the second locking protrusion portion and be elastically restored to be locked to the second locking protrusion, the second assuring locking portion begins to slide on the second slope while the connector locking portion stays on the first slope, the second assuring locking portion stays on the second slope until the first housing and the second housing are brought into the connector fitting state.

According to a third aspect of the invention, relating to the item (3), the repulsive force derived from the connector locking portion, the repulsive force derived from the first assuring locking portion and the repulsive force derived from the second assuring locking portion act when the second assuring locking portion stays on the second slope in the second half of the fitting stroke, and the repulsive force derived from the first assuring locking portion and the repulsive force derived from the second assuring locking portion act just before the fitting. Thus, the repulsive force against the fitting can be enhanced.

(4) The connector according to the item (2) or the item (3), wherein the first housing includes a locking covering portion in a position where the connector locking portion is allowed to be elastically deformed by the first slope, the locking covering portion covers an outside of the connector locking portion.

According to a fourth aspect of the invention, relating to the item (4), a locking part between the first locking protrusion portion and the connector locking portion is covered from the outside with the locking covering portion so that the fitting in the connector can be prevented from being unintentionally canceled by an external force acting on the locking part. In addition, when the locking covering portion is disposed outside and near a movable region of the connector locking portion, excessive displacement of the connector locking portion can be suppressed so that the first housing can be prevented from being damaged.

(5) The connector according to any one of the item (1) to the item (4), wherein the first housing includes a looseness preventing piece supported to the first housing and having a cantilevered-shape, the second housing includes a preventing piece regulating portion inserted inside the looseness preventing piece to regulate inward displacement of the looseness preventing piece when the completion of the fitting between the first housing and the second housing, the fitting assuring member includes a preventing piece pressing portion holding the looseness preventing piece between the preventing piece pressing portion and the preventing piece regulating portion while pressing the looseness preventing piece inward in accordance with sliding movement of the fitting assuring member relative to the first housing, the sliding movement of the fitting assuring member to a position where the preventing piece pressing portion presses the looseness preventing piece is allowed in the connector fitting state.

According to a fifth aspect of the invention, relating to the item (5), looseness of the first housing relative to the second housing and the fitting assuring member can be prevented by the looseness preventing piece in the connector fitting state. In addition, the preventing piece pressing portion presses the looseness preventing piece at a timing after the fitting in the connector. Accordingly, the looseness preventing piece can be pressed easily and held between the preventing piece pressing portion and the preventing piece regulating portion by inertial force acting for the fitting in the connector. Thus, there is no fear that feeling of insertion for the fitting in the connector may be impaired.

(6) The connector according to any one of the item (1) to the item (5), wherein the connector further comprises a retainer attached to an outside of the first housing, wherein the first housing includes a locking groove group including a formal locking groove and a temporary locking groove sandwiching a partition, the partition is partially absent or lower in height than a central portion of the partition on one end side of the locking groove group, the retainer includes a straight-line-shaped retainer protrusion selectively entering the formal locking groove or the temporary locking groove to engage with the locking groove group, the retainer protrusion is configured to get over the partition to move between the formal locking groove and the temporary locking groove by a bend of the retainer.

According to a sixth aspect of the invention, relating to the item (6), lifting height of the retainer protrusion required for moving the retainer from the formal locking groove to the temporary locking groove is lower on the one end side of the locking groove group than in the central portion, so that the one end side of the retainer protrusion can move more easily on the groove bottom side of the temporary locking groove than on the free end side thereof when the retainer is moved from the formal locking groove to the temporary locking groove. Accordingly, when the retainer is moved from the formal locking groove to the temporary locking groove, the one end side of the retainer protrusion hardly passes through the temporary locking groove, so that the retainer can be suppressed from dropping off due to unintentional release from locking.

(7) A connector unit comprising:

a first housing fitting to a second housing having a locking protrusion portion including a slope; and a fitting assuring member slidably attached to an outside of the first housing, the fitting assuring member including an assuring locking portion sliding on the slope to be elastically deformed in accordance with relative movement to the second housing, the assuring locking portion being configured to slide and move relatively to the first housing to get over the locking protrusion portion and be elastically restored to be locked to the locking protrusion portion upon the first housing and the second housing being fitted to each other, the assuring locking portion beginning to slide on the slope before completion of the fitting between the first housing and the second housing, the assuring locking portion staying on the slope until the completion of the fitting between the first housing and the second housing.

According to a seventh aspect of the invention, relating to the item (7), the assuring locking portion begins to slide on the slope before the first housing and the second housing are fitted to each other, and stays on the slope until the first housing and the second housing are fitted to each other. The assuring locking portion on the slope suffers reaction from the slope, and a component of the reaction acts on the fitting assuring member as a repulsive force against the fitting in the connector. Accordingly, the repulsive force derived from the assuring locking portion can be made to act until just before the fitting, so that half-fitting can be prevented.

According to the present invention, it is possible to make a repulsive force act surely until just before fitting.

DETAILED DESCRIPTION

Figure 1:
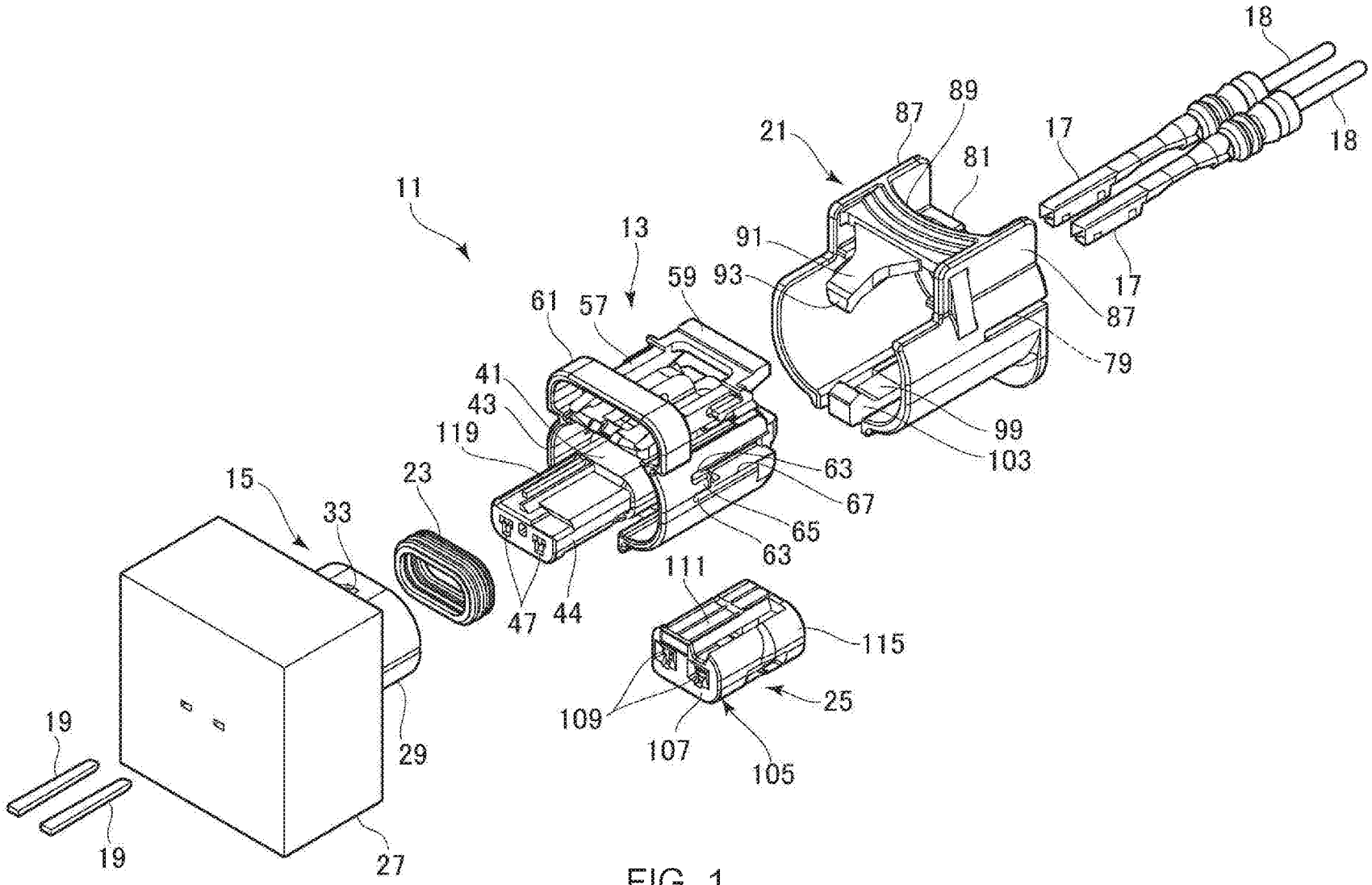
FIG. 1 is an exploded perspective view of a connector according to an embodiment of the present invention.
Figure 2:
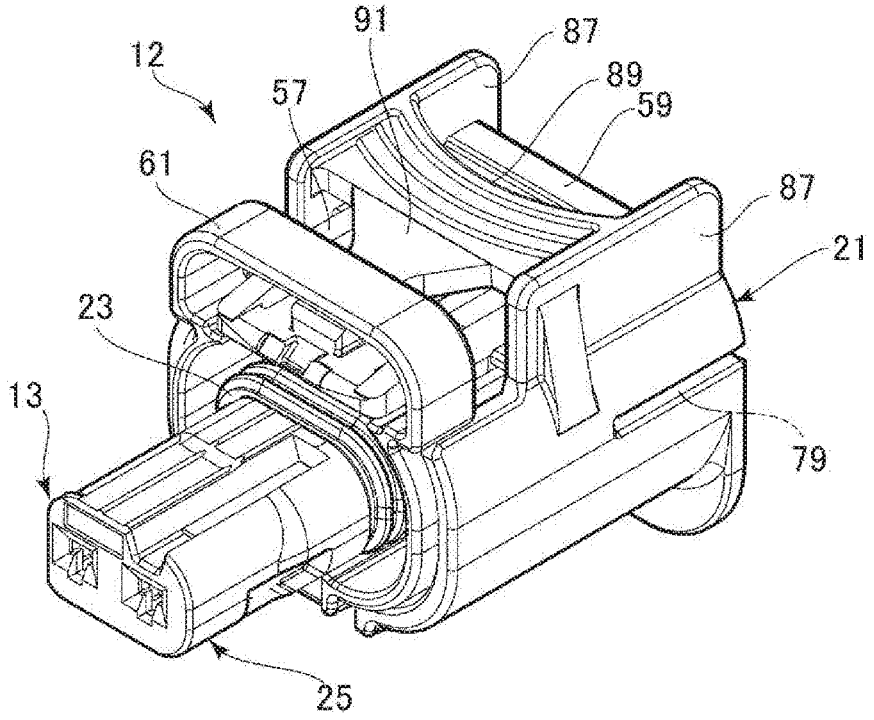
FIG. 2 is an external perspective view of a female connector unit.
Figure 3:
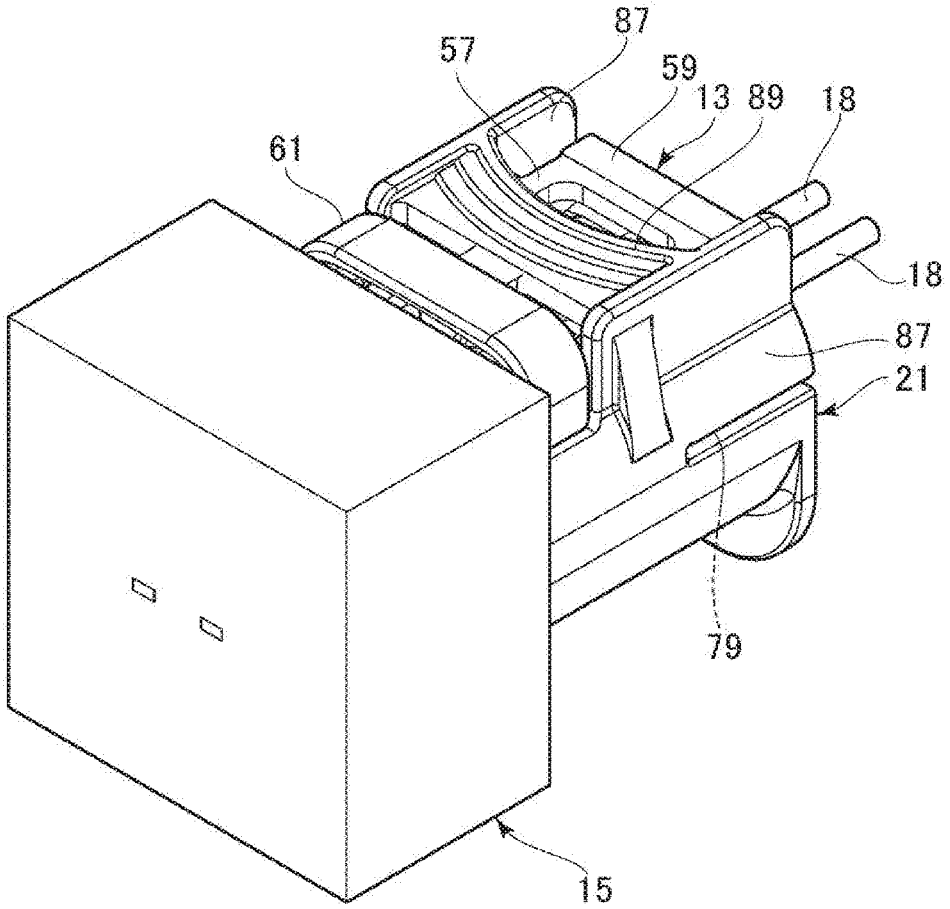
FIG. 3 is an external perspective view of a CPA formal locking state.

An embodiment of a connector for carrying out the present invention will be described below with reference to the drawings. FIG. 1 is an exploded perspective view of a connector 11 according to the embodiment; FIG. 2 is an external perspective view of a female connector unit (connector unit) 12 in which a CPA 21, a seal member 23 and a side retainer 25 have been attached to a female housing 13; FIG. 3 is an external perspective view of a connector fitting state; and FIGS. 4 to 8 are longitudinally sectional views showing movement from when the connector has not been fitted yet to when the CPA has been formally locked. Incidentally, the following description will be made on the assumption that the direction of fitting with a partner connector is a front side (front in the fitting direction); the direction of leaving the partner connector is a rear side (rear in the fitting direction); one side (upper in FIG. 4) in the connector height direction (height direction) substantially perpendicular to the fitting direction is an upper side, and the other side (lower in FIG. 4) is a lower side; and the connector width direction (width direction) substantially perpendicular to the fitting direction and the connector height direction is a left/right direction.

(Schematic Configuration of Connector 11)

As shown in FIG. 1, the connector 11 is configured to include a cylindrical female housing (first housing) 13, a cylindrical male housing (second housing) 15, female terminals (first terminals) 17 received in the female housing 13, male terminals (second terminals) 19 received in the male housing 15, a cylindrical CPA (fitting assuring member) 21 attached to the external surface of the female housing 13 slidably in the fitting direction, an annular seal member 23 attached to the female housing 13, and a side retainer (retainer) 25 attached to the female housing 13. The female housing 13, the CPA 21, the seal member 23 and the side retainer 25 constitutes a female connector unit 12. The connector 11 according to the embodiment connects the pair of the female terminals 17 and the pair of the male terminals 19 to each other respectively. The two female terminals 17 are received in the female housing 13, and the two male terminals 19 are received in the male housing 15. Incidentally, the first housing and the second housing may be set as a male housing and a female housing respectively contrary to those in the embodiment.

(Male Housing 15)

Figure 4:
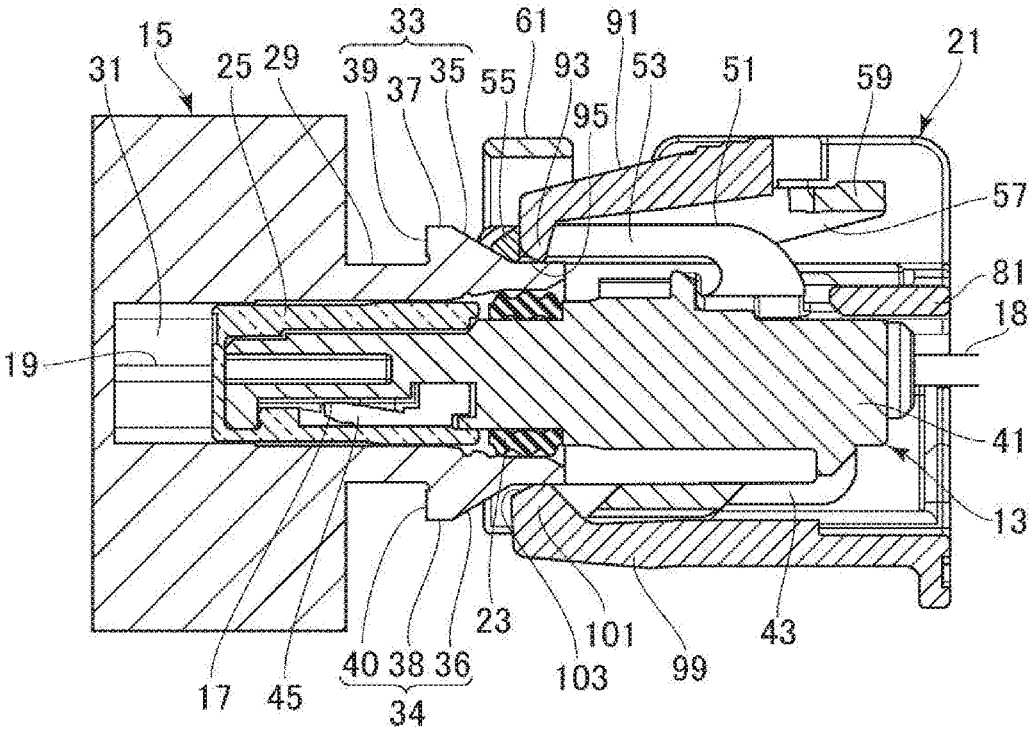
FIG. 4 is a longitudinally sectional view before fitting in the connector which has not been fitted yet.

The male housing 15 is made of synthetic resin. The male housing 15 is connected directly to an apparatus wall of a not-shown electric apparatus which is, for example, mounted on a vehicle or the like. As shown in FIG. 1, the male housing 15 has a proximal end portion 27 corresponding to the apparatus wall, and a cylindrical hood portion (preventing piece regulating portion) 29 extending in the fitting direction from the proximal end portion 27. As shown in FIG. 4, a bottomed space 31 having an inner circumferential surface which is axially continuous to the inner circumferential surface of the hood portion 29 is formed in the proximal end portion 27. The tab-like male terminals 19 protruding in the fitting direction are fixed on the back side of the space 31.

In the upper surface of the outer circumference of the hood portion 29, an upper locking protrusion (first locking protrusion portion) 33 is provided to protrude. As shown in FIG. 4, the upper locking protrusion 33 has an upper slope (first slope) 35 whose protruding height increases toward the rear, an upper flat face 37 connected to the upper end (rear end) of the upper slope 35 and extending in the front/rear direction, and an upper locking face 39 connected to the rear end of the upper flat face 37 and rising steeply and substantially vertically. The upper flat face 37 is set to be larger in width-direction length and shorter in front/back-direction length than the upper slope 35. Similarly, in the lower surface of the outer circumference of the hood portion 29, a lower locking protrusion (second locking protrusion portion) 34 is provided to protrude. The lower locking protrusion 34 has a lower slope (second slope) 36 whose protruding height increases toward the rear, and a lower flat face 38 connected to the lower end (rear end) of the lower slope 36 and extending in the front/rear direction. The lower flat face 38 is set to be larger in width-direction length and shorter in front/back-direction length than the lower slope 36. The upper locking protrusion 33 and the lower locking protrusion 34 are formed to be substantially vertically symmetric. In the fitting direction, the upper slope 35 and the lower slope 36 are disposed substantially in the same region, and the upper flat face 37 and the lower flat face 38 are disposed substantially in the same region.

(Female Housing 13)

The female housing 13 is made of synthetic resin. As shown in FIG. 4, the female housing 13 is formed by a cylindrical inner housing 41 and a cylindrical outer housing 43 which is put to surround an outer circumferential surface of the inner housing 41 at a distance from the outer circumferential surface. The hood portion 29 of the male housing 15 is inserted to a gap between the outer circumferential surface of the inner housing 41 and the inner circumferential surface of the outer housing 43.

Two female terminal receiving chambers 45 to which the female terminals 17 are inserted from the rear are formed in the inner housing 41. The female terminal receiving chambers 45 are opened to the outside through insertion ports 47 (see FIG. 1) which are formed in a distal end portion of the inner housing 41. The tab-like male terminals 19 are inserted into the insertion ports 47 respectively.

The inner housing 41 is formed to project frontward from the front end face of the outer housing 43. The seal member 23 is attached to the cylindrical outer circumferential surface of the inner housing 41 surrounded by the outer housing 43. The side retainer 25 is attached to the outer circumferential surface of an angularly cylindrical inner housing front portion 44 projecting frontward from the outer housing 43.

A housing arm 51 which can be elastically deformed is formed in the outer circumferential surface of the female housing 13. The housing arm 51 is formed like a gate. The housing arm 51 has a pair of left and right elastic arms pieces 53 and a locking piece (connector locking portion) 55. Each of the elastic arm pieces 53 is supported like a cantilever on the outer circumferential surface of the female housing 13 (inner housing 41) so as to extend toward the male housing 15 and substantially in parallel to the outer circumferential surface of the inner housing 41. The locking piece 55 bridges front end portions of the elastic arm pieces 53 to each other in the width direction. When the two housings 13 and 15 are fitted to each other, the locking piece 55 is locked to the upper locking protrusion 33 of the male housing 15.

The locking piece 55 swings upward (outward) with a rear end portion of the housing arm 51 as a fulcrum so that the housing arm 51 can be elastically deformed (flexurally deformed). Lock arms 57 like a gate are provided continuously to the housing arm 51. The lock arms 57 are supported like cantilevers respectively on the front end portions of the paired elastic arm pieces 53 so as to extend rearward. The lock arms 57 includes an operation portion 59 which is pressed when the locked state of the housing arm 51 is canceled. The operation portion 59 is disposed in a position higher than the elastic arm pieces 53.

The female housing 13 has a female housing bridge (locking covering portion) 61 which rises up from the opposite left and right ends of a front end upper portion of the outer housing 43, crosses the front end upper portion in the width direction, and covers the locking piece 55 from the outside (upper). The female housing bridge 61 is disposed in a position where the locking piece 55 is allowed to be elastically deformed by the upper slope 35 of the male housing 15, and near the outside (upper) of the movable region of the locking piece 55.

Figure 14:
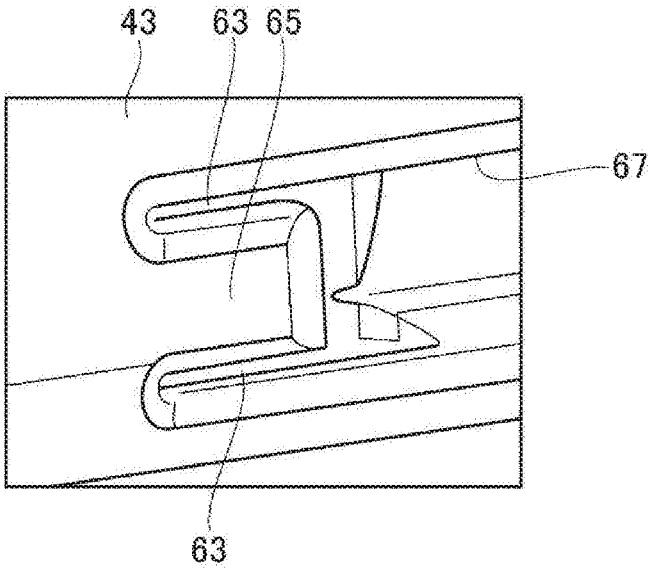
FIG. 14 is an enlarged view of a side lock.

As shown in FIG. 1 and FIG. 14, the female housing 13 has a pair of left and right side locks (looseness preventing pieces) 65 which are formed in such a manner that portions of left and right side walls of the outer housing 43 are notched by a pair of upper and lower slits 63. The side locks 65 are supported like cantilevers on the outer housing 43 so that front ends of the side locks 65 are continuously connected to the side walls of the outer housing 43 respectively, and rear ends of the side locks 65 serve as free ends respectively. The side locks 65 are positioned in front end portions of a pair of guide grooves 67 extending in the front/rear direction on the opposite left and right sides of the outer housing 43 respectively, and the upper and lower slits 63 extend frontward from the guide grooves 67.

(Side Retainer 25)

Figure 19:
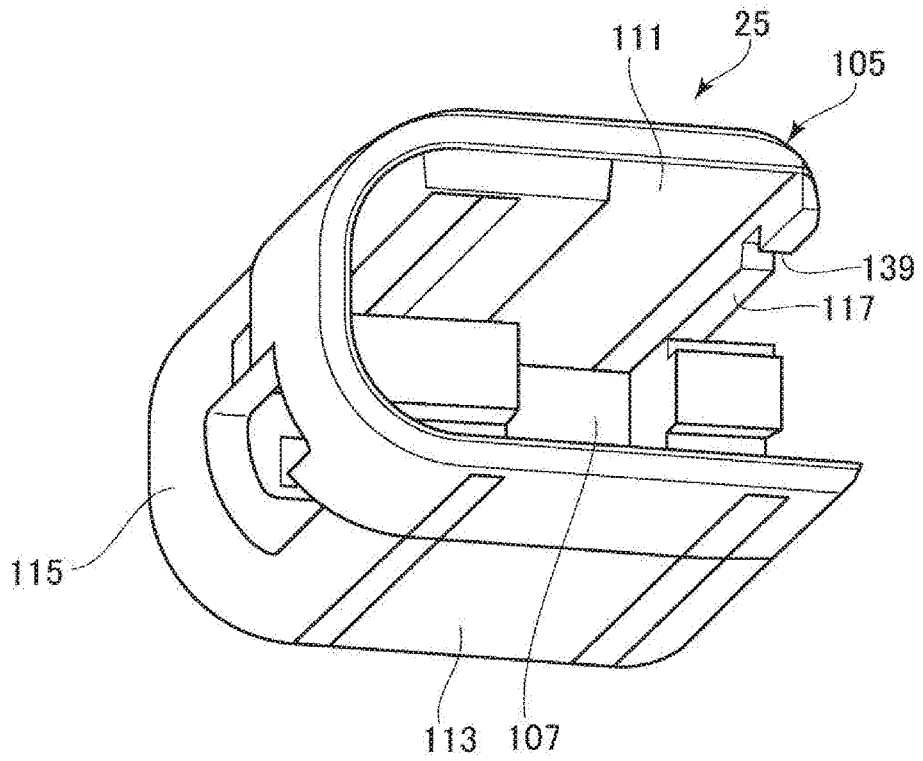
FIG. 19 is a perspective view of a side retainer.

The side retainer 25 is made of synthetic resin. As shown in FIG. 1 and FIG. 19, the side retainer 25 has a sectionally U-shaped retainer body 105 which is opened on one side (lateral side) in the width direction, and a retainer front plate portion 107 which covers the front end of the retainer body. Two insertion ports 109 are formed in the retainer front plate portion 107. In a state where the side retainer 25 is set at a formal locking position as will be described later, the insertion ports 109 communicate with the insertion ports 47 of the inner housing 41, and the male terminals 19 are inserted from the insertion ports 47 and 109.

The retainer body 105 has a retainer upper face portion 111, a retainer lower face portion 113 and a retainer curved face portion 115 integrally. The retainer upper face portion 111 and the retainer lower face portion 113 are separated vertically so as to be opposed to each other. The retainer curved face portion 115 connects an edge of the retainer upper face portion 111 and an edge of the retainer lower face portion 113 continuously. A retainer protrusion 117 extending like a straight line in the fitting direction is provided to protrude downward at an opening-side edge of the retainer upper face portion 111. A notch 139 is formed at a rear end portion of the retainer protrusion 117 so that a jig 149 (see FIG. 21) can be inserted thereto. The jig 149 is used when the side retainer 25 is moved from a formal locking position to a temporary locking position as will be described later.

Figure 18:
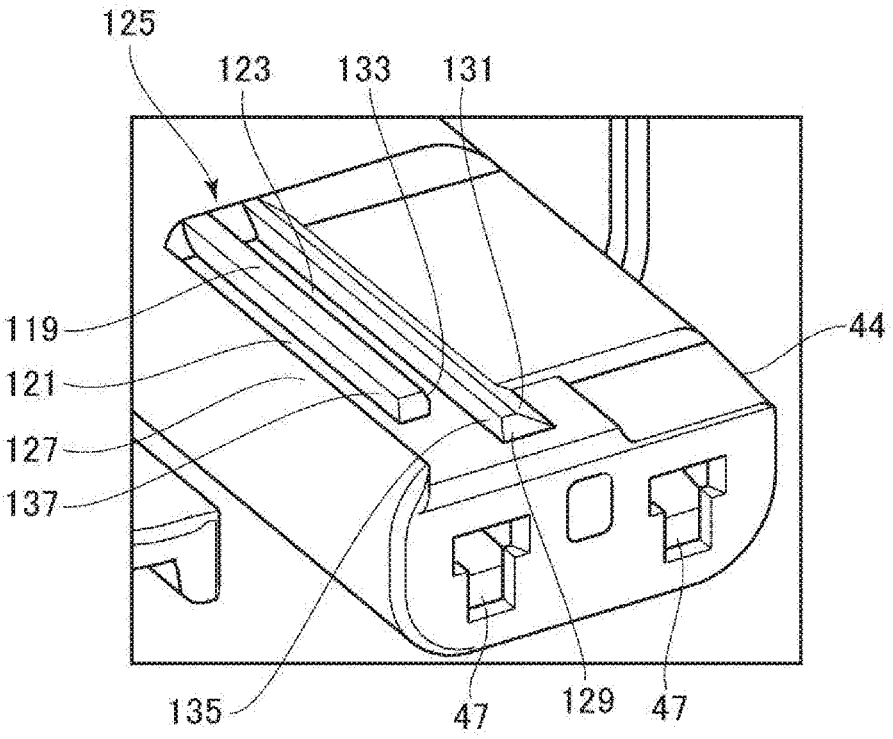
FIG. 18 is a perspective view of an inner housing front portion.

As shown in FIG. 18, a locking groove group 125 including a formal locking groove 121 and a temporary locking groove 123 extending in parallel with a partition 119 therebetween is provided in the upper surface of the inner housing front portion 44. The partition 119, the formal locking groove 121 and the temporary locking groove 123 extend like straight lines in the fitting direction. The formal locking groove 121 is defined between a side wall upper end portion 127 of the inner housing front portion 44 protruding from the upper surface of the inner housing front portion 44 and the partition 119. The temporary locking groove 123 is defined between a groove forming protrusion 129 protruding from the upper surface of the inner housing front portion 44 and the partition 119.

Figure 20A:
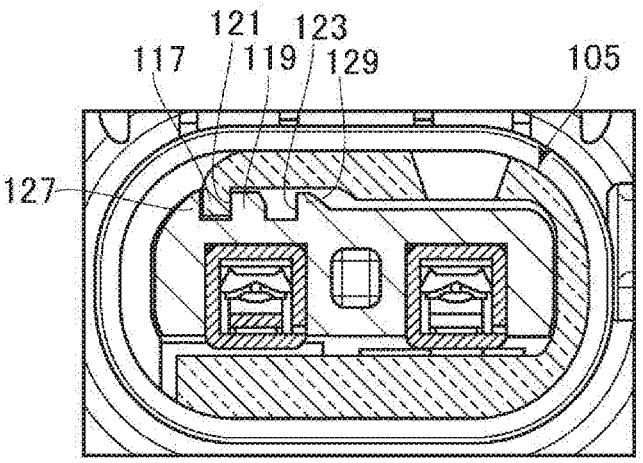
FIG. 20A and FIG. 20B are longitudinally sectional views of the inner housing front portion and the side retainer, FIG. 20A showing a formal locking position, FIG. 20B showing a temporary locking position.
Figure 20B:
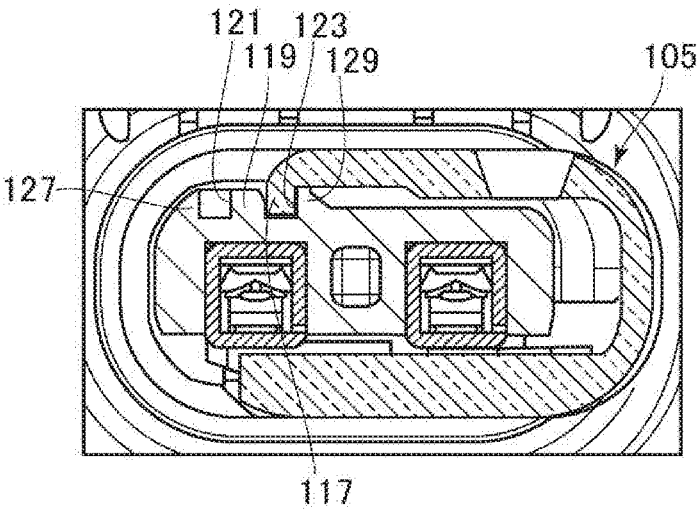

When the side retainer 25 is attached to the inner housing front portion 44, an opening at a side of the side retainer 25 is slightly expanded, and the inner housing front portion 44 is inserted into the side retainer 25 through the opening and moved in the width direction (attachment direction). When the side retainer 25 is moved in the attachment direction, the retainer protrusion 117 enters the temporary locking groove 123 to be thereby locked (in a temporary locking position) as shown in FIG. 20B. When the side retainer 25 is further moved in the attachment direction, the retainer protrusion 117 enters the formal locking groove 121 to be thereby locked (in a formal locking position) as shown in FIG. 20A.

A side face of the groove forming protrusion 129 outside the groove is a first slope 131. When the side retainer 25 is pushed in the attachment direction, the retainer protrusion 117 slides on the first slope 131 comparatively easily so that the side retainer 25 is bent and gets over the groove forming protrusion 129. Thus, the side retainer 25 is mounted at the temporary locking position. A side face of the partition 119 on the temporary locking groove 123 side is a second slope 133 which is slightly steeper than the first slope 131. When the side retainer 25 is pushed more strongly than when it is mounted at the temporary locking position, the retainer protrusion 117 slides on the second slope 133 so that the side retainer 25 is bent and gets over the partition 119. Thus, the side retainer 25 moves from the temporary locking position to the formal locking position.

On the other hand, a side face of the groove forming protrusion 129 on the temporary locking groove 123 and a side face of the partition 119 on the formal locking groove 121 side are vertical faces 135 and 137. Even if the side retainer 25 is pulled simply in a removal direction (an opposite direction to the attachment direction), the side retainer 25 cannot be moved from the formal locking position to the temporary locking position or removed from the temporary locking position easily.

The partition 119 is shorter than the retainer protrusion 117. On the front end side of the locking groove group 125, the partition 119 is partially absent so that the formal locking groove 121 and the temporary locking groove 123 have the same depth and communicate with each other. Alternatively, the partition 119 on the front end side of the locking groove group 125 may be formed to be lower in height than any other region (a central portion and a rear end portion).

The side retainer 25 set at the temporary locking position allows the female terminals 17 to be inserted into the female terminal receiving chambers 45, and is locked to the inserted female terminals 17 to thereby inhibit the female terminals 17 from being extracted. On the other hand, the side retainer 25 set at the formal locking position inhibits the female terminals 17 from being both inserted into and extracted from the female terminal receiving chambers 45.

(CPA 21)

The CPA 21 is made of synthetic resin. The CPA 21 is spread over the female housing 13 from the rear and attached thereto slidably in the fitting direction. A pair of left and right side walls 87 rising up at a distance from each other in the width direction and a support wall 89 bridging upper end portions of the side walls 87 to each other are formed in the CPA 21. A CPA upper arm 91 is formed in a central portion of the support wall 89 so as to extend toward the male housing 15. A pair of left and right ridge portions 79 are provided to protrude on rear portion inner surfaces of the left and right side walls 87 respectively so that the left and right ridge portions 79 are guided by the left and right guide grooves 67 of the female housing 13 (see FIG. 15). The rear ends between the left and right side walls 87 are coupled by a CPA bridge 81 for securing rigidity in the CPA 21.

Figure 15:
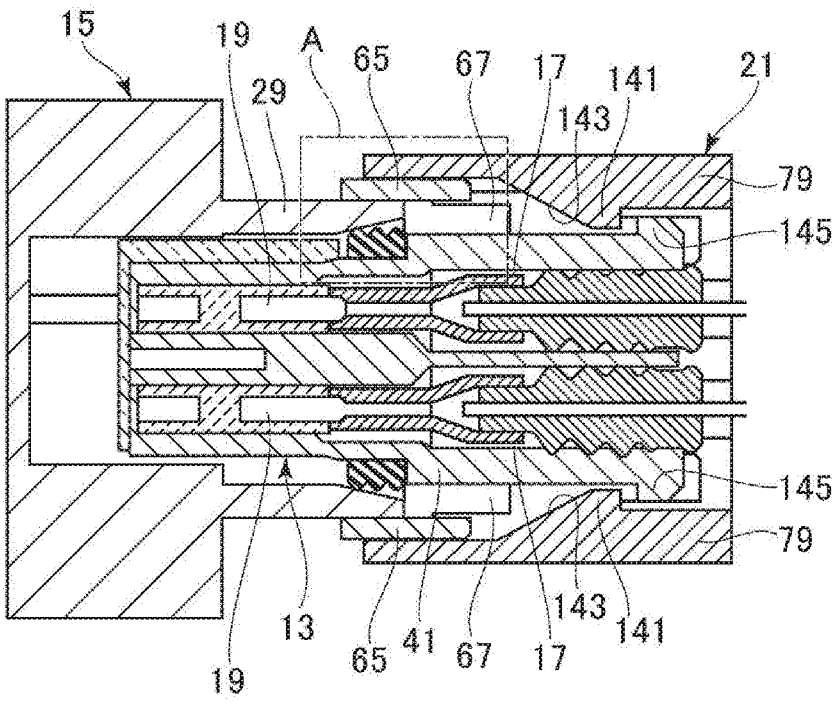
FIG. 15 is a cross-sectional view of the connector which has not been fitted yet.
Figure 16:
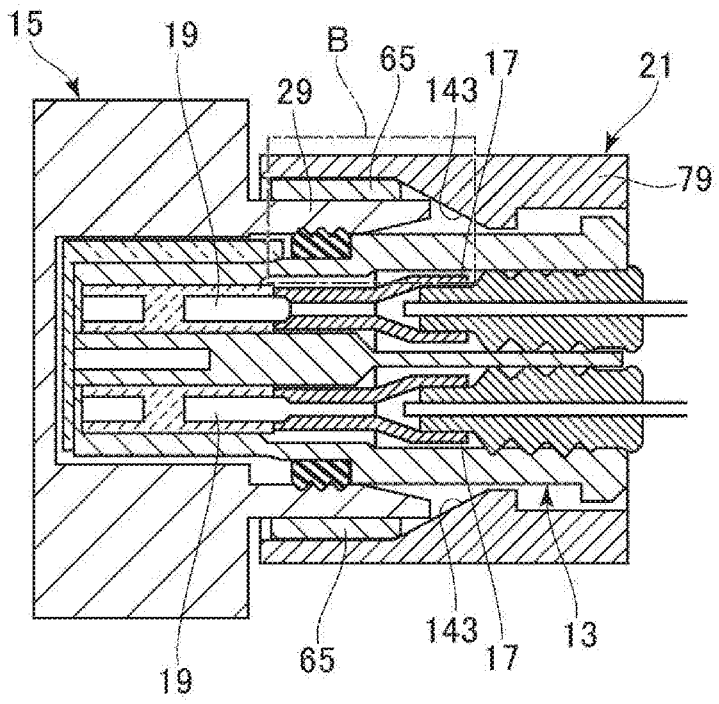
FIG. 16 is a cross-sectional view showing the CPA formal locking state.
Figure 17A:
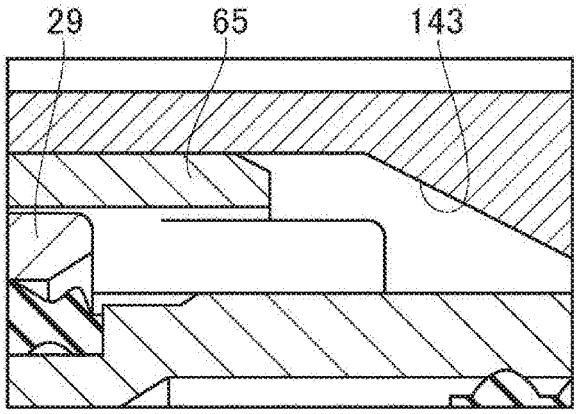
FIG. 17A is an enlarged view of a portion A in FIG. 15.
Figure 17B:
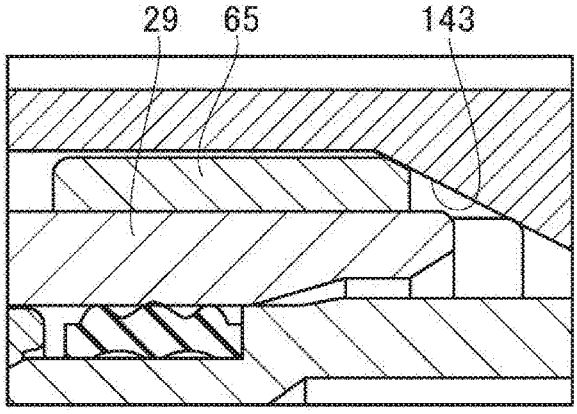
FIG. 17B is an enlarged view of a portion B in FIG. 16.

As shown in FIG. 15, a dropping-off preventing protrusion 141 protruding inward is provided in each of the ridge portions 79. A guide face (preventing piece pressing portion) 143 inclined outward toward the front is formed in a front portion of the dropping-off preventing protrusion 141. A pair of left and right stopper protrusions 145 protruding outward are formed at the rear end of the inner housing 41.

The CPA upper arm 91 is supported like a cantilever on the support wall 89, and provided to be inclined downward toward the hood portion 29 of the male housing 15. An upper locking claw (first assuring locking portion) 93 extending downward is formed in a distal end portion of the CPA upper arm 91. A slope 95 is formed in a low portion front face of the upper locking claw 93. The upper locking claw 93 swings upward (outward) with a rear end portion of the CPA upper arm 91 as a fulcrum so that the CPA upper arm 91 can be elastically deformed (flexurally deformed). In the embodiment, when the CPA 21 is attached to the female housing 13, the upper locking claw 93 (slope 95) of the CPA upper arm 91 gets over the operation portion 59 of the lock arms 57 and abuts against a rear end portion of the locking piece 55 of the housing arm 51 so as to press the rear end portion of the locking piece 55 in the fitting direction (frontward) when the two housings 13 and 15 are fitted to each other.

The CPA 21 has a CPA lower arm 99 which is supported like a cantilever in a position facing the CPA upper arm 91 (a position away therefrom by about 180 degrees). The CPA lower arm 99 extends toward the male housing 15. A lower locking claw (second assuring locking portion) 101 extending toward the inside of the CPA 21 is formed in a distal end portion of the CPA lower arm 99. A slope 103 is formed in an upper portion front face of the lower locking claw 101. In the same manner as the CPA upper arm 91, the lower locking claw 101 swings downward (outward) with a rear end portion of the CPA lower arm 99 as a fulcrum so that the CPA lower arm 99 can be elastically deformed (flexurally deformed).

(Fitting Procedure of Connector 11)

Next, the other configuration of the aforementioned connector 11 will be described along explanation about the fitting procedure of the connector 11 according to the embodiment. The following description will be made along the operation of the connector 11 when the female housing 13 is made close to the male housing 15 connected directly to an apparatus wall of an electric apparatus by way of example.

First, the seal member 23 is attached to the female housing 13, and the side retainer 25 is attached to the temporary locking position of the inner housing front portion 44 protruding from the outer housing 43. Successively, the female terminals 17 to which electric wires 18 have been connected are inserted into the female terminal receiving chambers 45 of the female housing 13 from the rear, and the side retainer 25 is slid to the formal locking position (regular position). Thus, the female terminals 17 are locked to the side retainer 25 so as to be prevented from dropping off.

Next, the CPA 21 is attached to the female housing 13 from the rear. On this occasion, in the CPA 21, the paired ridge portions 79 are guided by the guide grooves 67. When the stopper protrusions 145 get over the guide faces 143 and arrive at the rears of the dropping-off preventing protrusions 141, the CPA 21 is locked to the female housing 13 so as to be prevented from dropping off (CAP temporary locked). In addition, the CPA upper arm 91 gets over the operation portion 59 of the female housing 13 and moves inside the housing arm 51 so as to abut against the rear end face of the locking piece 55. When the CPA upper arm 91 abuts against the locking piece 55 in this manner, the CPA 21 can press the male housing 15 in the fitting direction. Thus, the positional accuracy between the CPA 21 and the female housing 13 at the time of fitting can be enhanced to improve the assembling workability.

When the CPA 21 is moved frontward relatively to the female housing 13, the CPA upper arm 91 abuts against the locking piece 55. Thus, the female housing 13 moves frontward together with the CPA 21. On the contrary, when the CPA 21 is moved rearward relatively to the female housing 13, the stopper protrusions 145 are locked to the dropping-off preventing protrusions 141. Thus, the female housing 13 moves rearward together with the CPA 21.

When the female housing 13 is adjusted to the position of the male housing 15 in the CPA temporary locked state and the CPA 21 is pushed in the fitting direction (frontward), the inner housing 41 of the female housing 13 is inserted into the hood portion 29 of the male housing 15, and the distal end portions of the male terminals 19 are inserted into the insertion ports 47. In this stage, each of the housing arm 51 and the CPA upper arm 91 is separated from the upper locking protrusion 33, and no flexural deformation occurs. In addition, the CPA lower arm 99 is also separated from the lower locking protrusion 34, and no flexural deformation occurs.

Figure 9:
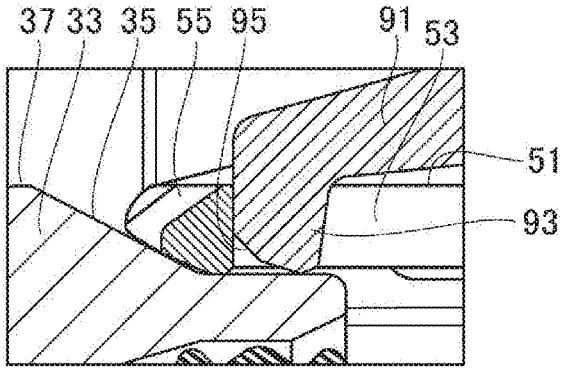
FIG. 9 is a partially enlarged view of FIG. 4 showing an upper locking part.

When the CPA 21 is further pushed in the fitting direction, the locking piece 55 of the housing arm 51 reaches the upper slope 35 of the upper locking protrusion 33 and rides thereon as shown in FIG. 4 and FIG. 9, in which the locking piece 55 begins to slide on the upper slope 35 so that the locking piece 55 is pressed against the upper slope 35 and the housing arm 51 is elastically deformed upward. Thus, the restoring force of the housing arm 51 acts on the upper slope 35 so that the male housing 15 is urged in the opposite direction to the fitting direction by the female housing 13, and the female housing 13 suffers reaction from the male housing 15. As a result, as soon as the CPA 21 is released from being gripped by a hand, the female housing 13 is pushed back in the opposite direction to the fitting direction together with the CPA 21. Incidentally, in the state of FIG. 4, the CPA lower arm 99 is separated from the lower locking protrusion 34, and no flexural deformation occurs.

Figure 5:
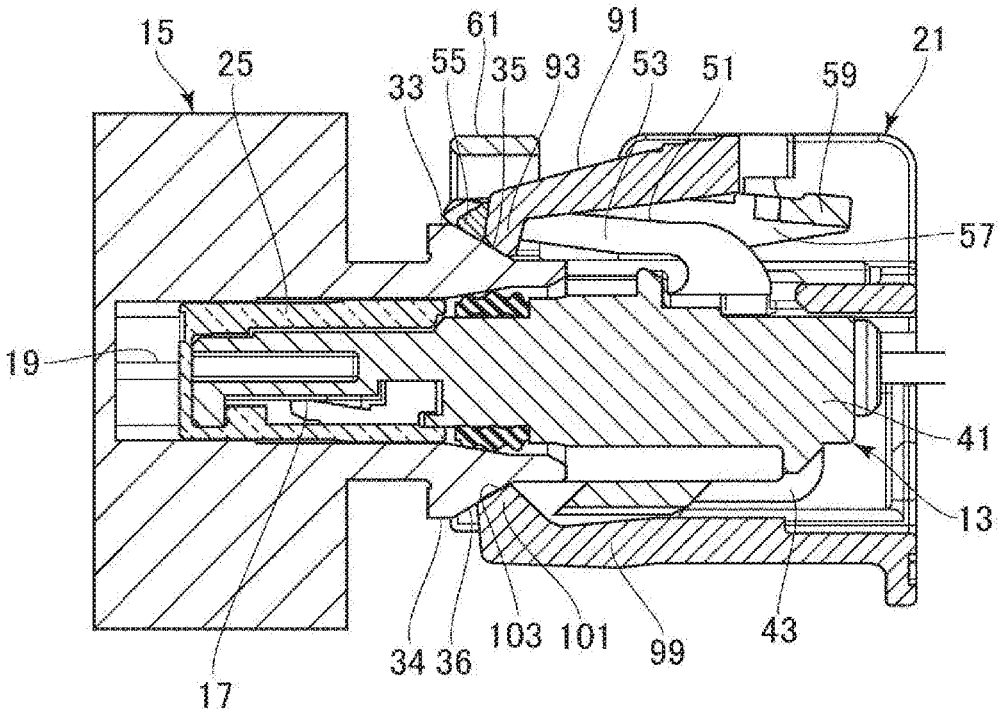
FIG. 5 is a longitudinally sectional view of the connector which is being fitted.
Figure 10A:
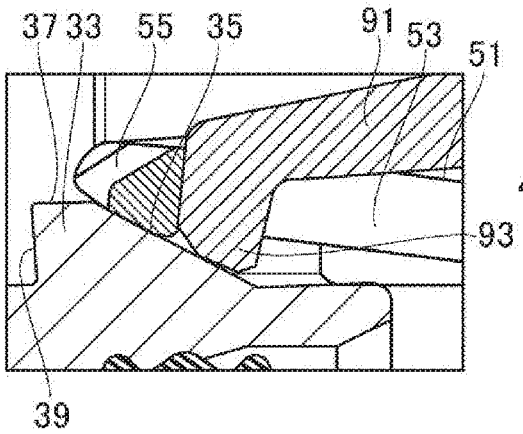
FIG. 10A and FIG. 10B are partially enlarged views of FIG. 5, FIG. 10A showing the upper locking part, FIG. 10B showing a lower locking part.
Figure 10B:
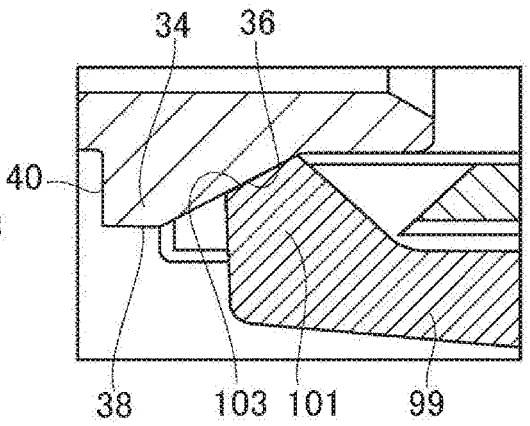

When the CPA 21 is further pushed in the fitting direction in the state of FIG. 4, the upper locking claw 93 of the CPA upper arm 91 reaches the upper slope 35 of the upper locking protrusion 33 and rides thereon as shown in FIG. 5 and FIG. 10A, in which the upper locking claw 93 begins to slide on the upper slope 35 so that the upper locking claw 93 is pressed against the upper slope 35 and the CPA upper arm 91 is elastically deformed upward. Thus, the restoring force of the CPA upper arm 91 acts on the upper slope 35 so that the male housing 15 is urged in the opposite direction to the fitting direction by the CPA 21, and the CPA 21 suffers reaction from the male housing 15. In addition, at the time when the upper locking claw 93 of the CPA upper arm 91 begins to slide on the upper slope 35 of the upper locking protrusion 33, the locking piece 55 of the housing arm 51 is also sliding on the upper slope 35. The female housing 13 also suffers reaction from the upper slope 35 due to the elastic deformation of the locking piece 55. Further, substantially at the same timing as the upper locking claw 93 of the CPA upper arm 91 begins to slide on the upper slope 35, the lower locking claw 101 of the CPA lower arm 99 begins to slide on the lower slope 36 of the lower locking protrusion 34 so that the lower locking claw 101 is pressed against the lower slope 36 and the CPA lower arm 99 is elastically deformed downward, as shown in FIG. 10B. Thus, the restoring force of the CPA lower arm 99 acts on the lower slope 36 so that the male housing 15 is urged in the opposite direction to the fitting direction by the CPA 21, and the CPA 21 suffers reaction from the male housing 15.

Figure 6:
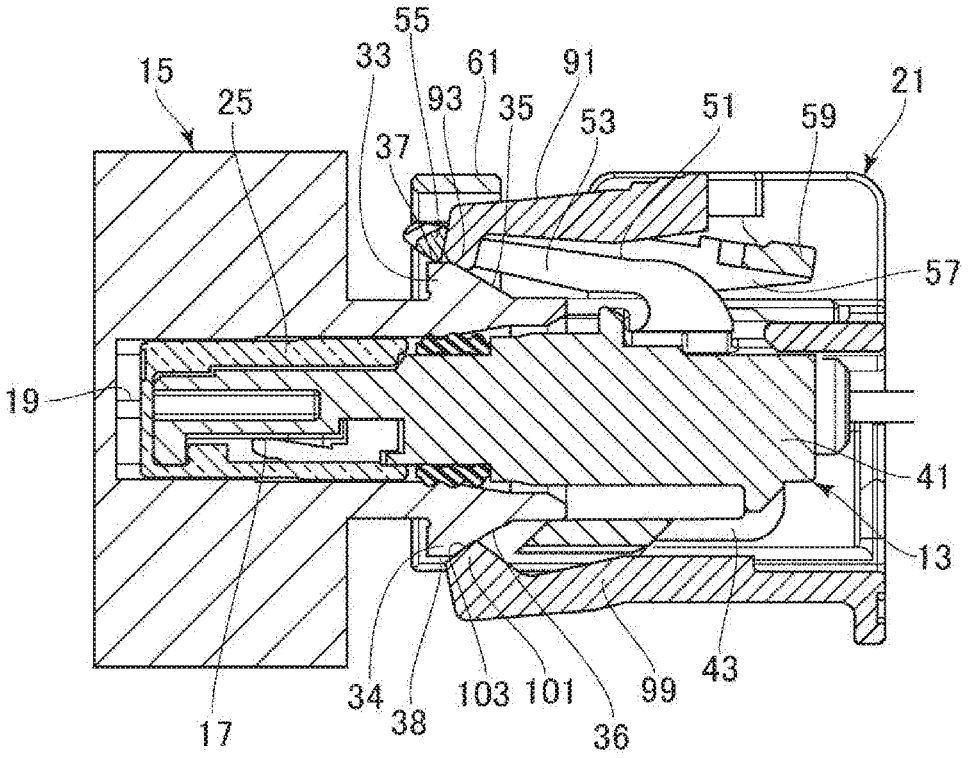
FIG. 6 is a longitudinally sectional view of the connector which is being fitted.
Figure 11A:
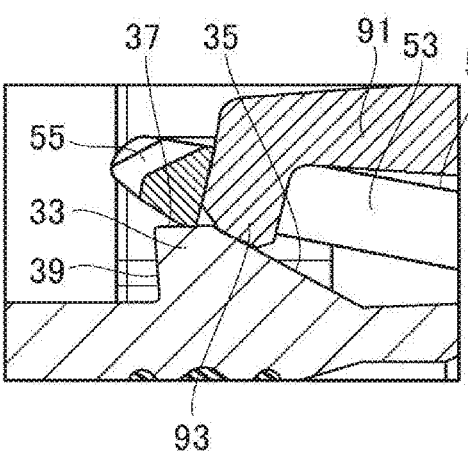
FIG. 11A and FIG. 11B are partially enlarged views of FIG. 6, FIG. 11A showing the upper locking part, FIG. 11B showing the lower locking part.
Figure 11B:
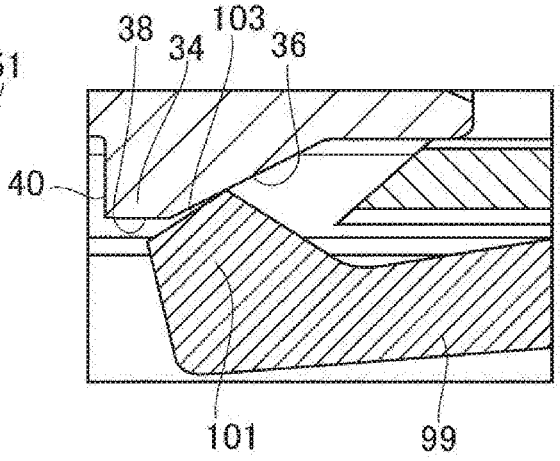

When the CPA 21 is further pushed in the fitting direction in the state of FIG. 5, the locking piece 55 of the housing arm 51 gets over the upper slope 35 and reaches the upper flat face 37 as shown in FIG. 6 and FIG. 11A. Thus, the restoring force of the housing arm 51 no longer acts on the upper slope 35, so that the housing arm 51 cannot push back the male housing 15.

With respect to this point, according to the embodiment, the upper locking claw 93 of the CPA upper arm 91 is set to still stay on the upper slope 35 at the time when the locking piece 55 rides on the upper flat face 37. Accordingly, the CPA 21 suffers reaction from the upper slope 35 due to the elastic deformation of the upper locking claw 93. In the same manner, the lower locking claw 101 of the CPA lower arm 99 is set to still stay on the lower slope 36 at the time when the locking piece 55 rides on the upper flat face 37.

Accordingly, the CPA 21 also suffers reaction from the lower slope 36 due to the elastic deformation of the lower locking claw 101.

When the CPA 21 is further pushed in the fitting direction in the state of FIG. 6, the upper locking claw 93 keeps sliding on the upper slope 35 and the lower locking claw 101 keeps sliding on the lower slope 36 while the locking piece 55 moves on the upper flat face 37.

Figure 7:
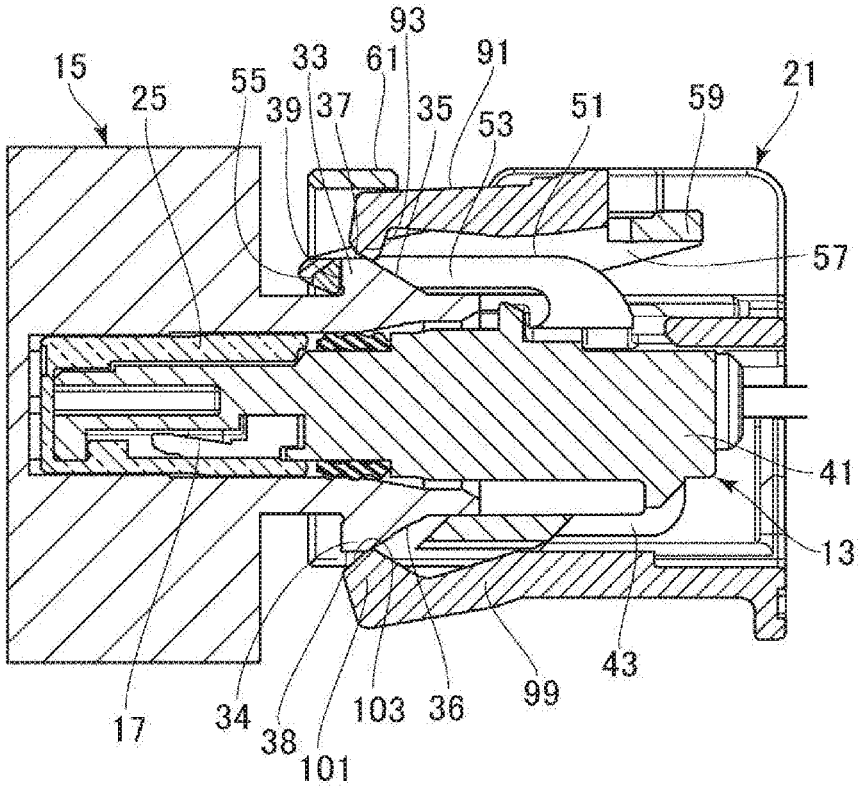
FIG. 7 is a longitudinally sectional view of the connector which has been fitted.
Figure 12A:
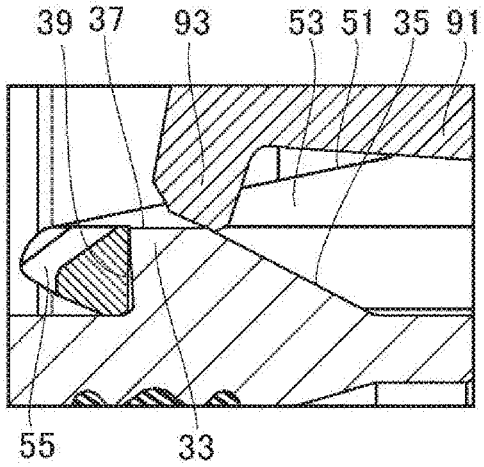
FIG. 12A and FIG. 12B are partially enlarged views of FIG. 7, FIG. 12A showing the upper locking part, FIG. 12B showing the lower locking part.
Figure 12B:
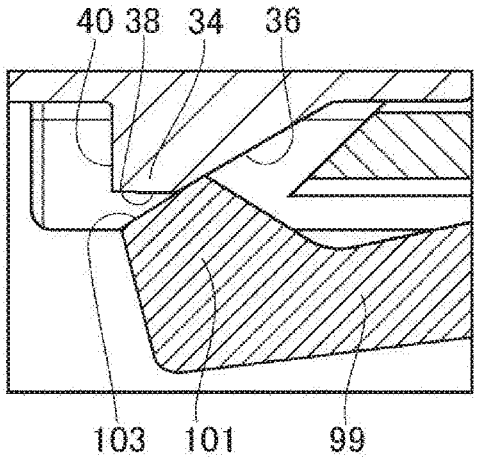

Then, as shown in FIG. 7 and FIG. 12A, when the locking piece 55 passes through the upper flat face 37, the locking piece 55 is elastically restored and locked to the upper locking face 39 of the upper locking protrusion 33 so that the two housings 13 and 15 are brought into a state (connector fitting state) where they are locked to each other. At the time when the fitting is thus completed, the upper locking claw 93 of the CPA upper arm 91 still stays on the upper slope 35, and the lower locking claw 101 of the CPA lower arm 99 also stays on the lower slope 36. Accordingly, the CPA 21 continuingly suffers reaction from the upper slope 35 due to the elastic deformation of the upper locking claw 93 and reaction from the lower slope 36 due to the elastic deformation of the lower locking claw 101.

Figure 8:
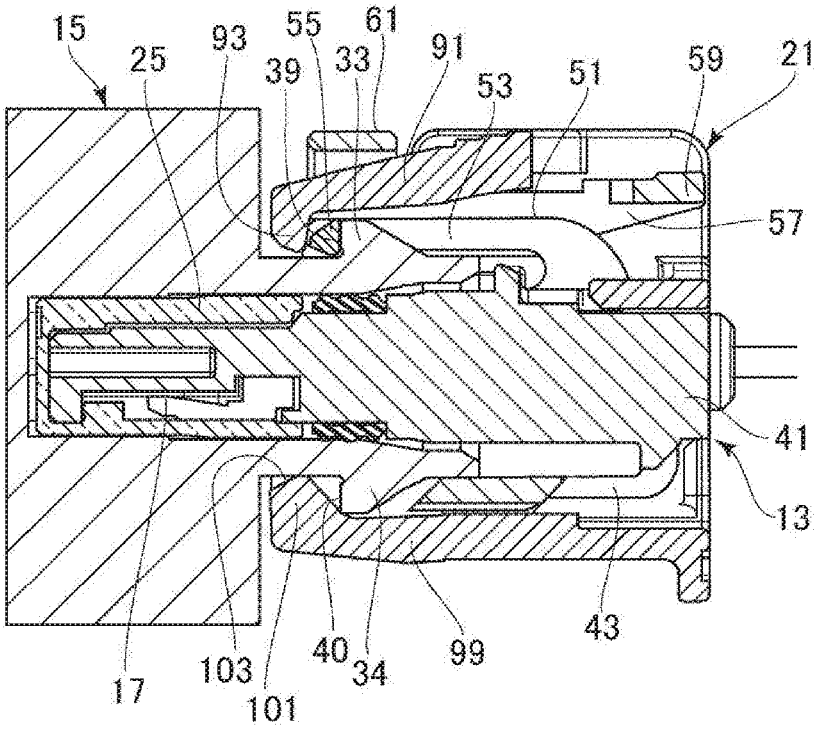
FIG. 8 is a longitudinally sectional view showing a CPA formal locking state.
Figure 13A:
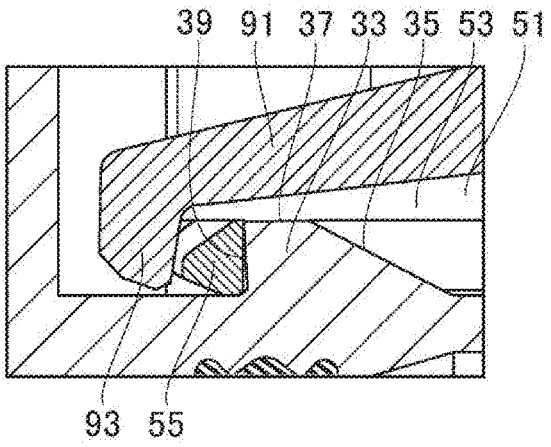
FIG. 13A and FIG. 13B are partially enlarged views of FIG. 8, FIG. 13A showing the upper locking part, FIG. 13B showing the lower locking part.
Figure 13B:
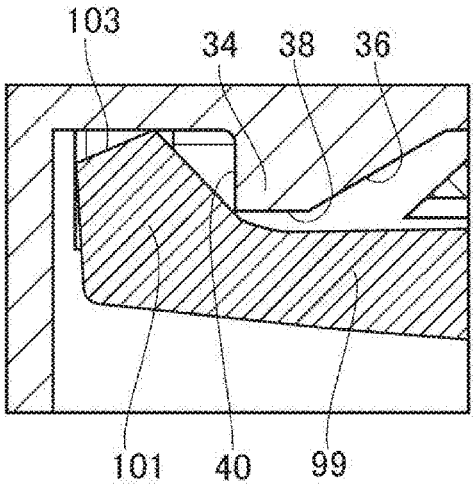

Successively, the upper locking claw 93 passes through the upper flat face 37, and gets over the locking piece 55 locked to the upper locking protrusion 33. After that, as shown in FIG. 8 and FIG. 13A, the upper locking claw 93 is elastically restored and locked to the upper locking face 39 while holding the locking piece 55 therebetween (CPA formal locked). Thus, in the state where the CPA upper arm 91 is locked to the upper locking protrusion 33, the two housings 13 and 15 are always locked. Therefore, the fitting between the two housings 13 and 15 is assured by the fitting of the CPA upper arm 91. In addition, since the locking piece 55 is held between the upper locking protrusion 33 and the upper locking claw 93, the female housing 13 is suppressed from dropping off. Incidentally, the lower locking claw 101 which has passed through the lower flat face 38 is elastically restored and locked to the lower locking protrusion 34 substantially at the same timing as the upper locking claw 93 is locked, as shown in FIG. 13B.

In this manner, according to the embodiment, the upper locking claw 93 of the CPA upper arm 91 begins to slide on the upper slope 35 before the female housing 13 and the male housing 15 are fitted to each other. The upper locking claw 93 stays on the upper slope 35 until the female housing 13 and the male housing 15 are fitted to each other. The upper locking claw 93 on the upper slope 35 suffers reaction from the upper slope 35, and a component of the reaction acts on the CPA 21 as a repulsive force against the fitting in the connector. Accordingly, the repulsive force derived from the upper locking claw 93 (CPA upper arm 91) can be made to act until just before the fitting, so that half-fitting can be prevented.

In addition, the locking piece 55 on the upper slope 35 suffers reaction from the upper slope 35, and a component of the reaction acts on the female housing 13 as a repulsive force against the fitting in the connector. Accordingly, the repulsive force derived from the locking piece 55 acts in, of the whole region of a fitting stroke from when the locking piece 55 begins to slide on the upper slope 35 until the locking piece 55 is locked to the upper locking protrusion 33, the first half until the upper locking claw 93 begins to slide on the upper slope 35, and the repulsive force derived from the locking piece 55 and the repulsive force derived from the upper locking claw 93 act in the second half from when the upper locking piece 93 begins to slide on the upper slope 35 until the locking piece 55 rides on the upper flat face (top face) 37 of the upper locking protrusion 33. Further, the repulsive force derived from upper locking claw 93 acts just before the fitting from when the locking piece 55 rides on the upper flat face 37 of the upper locking protrusion 33 until the locking piece 55 is locked to the upper locking protrusion 33. That is, some repulsive force can be made to act all over the fitting stroke.

Further, when the lower locking claw 101 stays on the lower slope 36 in the second half of the fitting stroke, the repulsive force derived from the locking piece 55, the repulsive force derived from the upper locking claw 93 and the repulsive force derived from the lower locking claw 101 act. Just before the fitting, the repulsive force derived from the upper locking claw 93 and the repulsive force derived from the lower locking claw 101 act. Accordingly, the repulsive force against the fitting can be enhanced.

In addition, since a locking part between the upper locking protrusion 33 and the locking piece 55 and a locking part between the upper locking protrusion 33 and the upper locking claw 93 are covered with the female housing bridge 61 from the outside, the fitting in the connector can be prevented from being unintentionally canceled due to an external force acting on such a locking part. In addition, since the female housing bridge 61 is disposed outside and near the movable region of the locking piece 55, excessive displacement of the locking piece 55 (excessive deformation of the housing arm 51) can be suppressed by the female housing bridge 61, so that the female housing 13 can be prevented from being damaged.

(Preventing Looseness in Female Housing 13 Due to Side Lock 65)

As shown in FIG. 14 to FIG. 17, the paired left and right side locks 65 are formed in the outer housing 43 so that the hood portion 29 of the male housing 15 can be inserted to the inside between the side locks 65 due to fitting with the female housing 13, so as to regulate inward displacement of the side locks 65. When the CPA 21 slides and moves from the temporary locking state to the formal locking state, the guide faces 143 of the dropping-off preventing protrusions 141 of the CPA 21 press the side locks 65 inward and hold the side locks 65 between the guide faces 143 and the hood portion 29 respectively. In addition, relative movement between the female housing 13 and the CPA 21 in the fitting direction is regulated in the CPA temporary locked state. By the fitting in the connector, the CPA 21 can slide and move from the temporary locking state to the formal locking state. That is, the sliding movement of the CPA 21 to the position where the female housing guide faces 143 press the side locks 65 is allowed by the fitting between the female housing 13 and the male housing 15.

Thus, in the connector fitting state, looseness in the female housing 13 relative to the male housing 15 and the CPA 21 can be prevented by the side locks 65. In addition, since the guide faces 143 press the side locks 65 at a timing after the fitting in the connector, the side locks 65 can be pressed easily and held between the guide faces 143 and the hood portion 29 by inertial force acting for the fitting in the connector. Thus, there is no fear that feeling of insertion for the fitting in the connector may be impaired.

(Moving Side Retainer 25 from Formal Locking Position to Temporary Locking Position)

Figure 21:
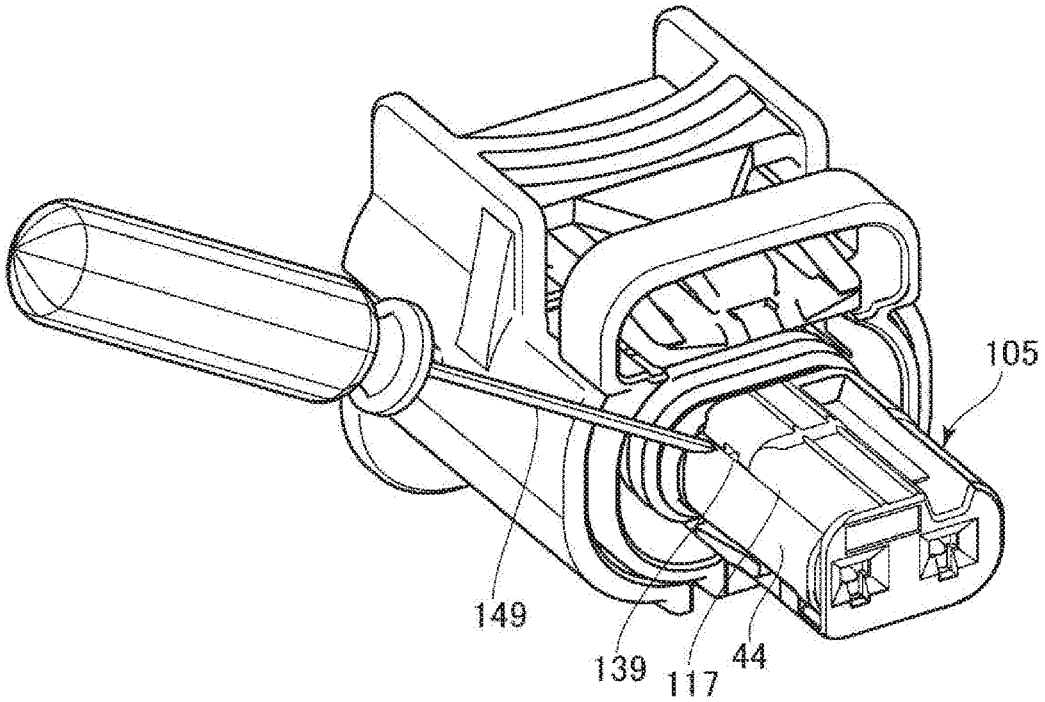
FIG. 21 is a perspective view showing a state where the side retainer has not been moved by a jig yet.
Figure 22:
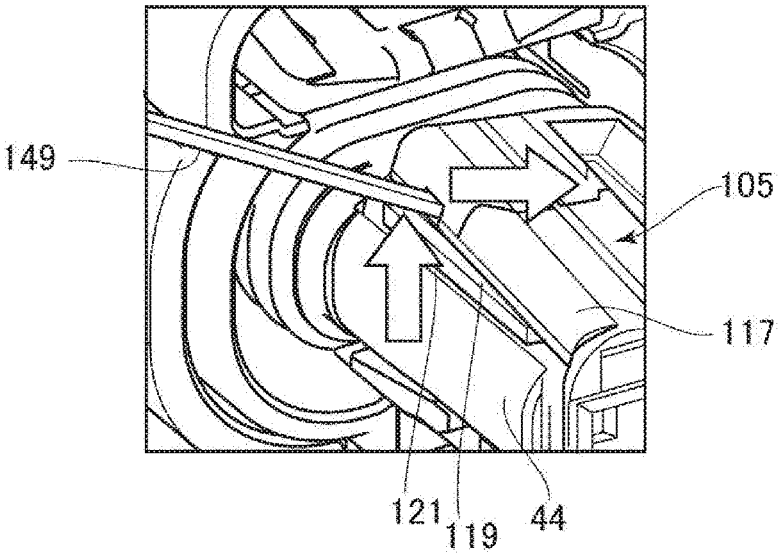
FIG. 22 is a perspective view showing a state where the side retainer is being moved by the jig.

As described above, the side retainer 25 cannot be moved from the formal locking position to the temporary locking position even if the side retainer 25 is pulled simply in the removal direction. Therefore, in order to move the side retainer 25 from the formal locking position to the temporary locking position, a distal end of the jig 149 is inserted into the notch 139 of the retainer protrusion 117 so that the side retainer 25 is lifted up and moved relatively to the inner housing front portion 44 by the jig 149, as shown in FIG. 21 and FIG. 22.

Figure 23:
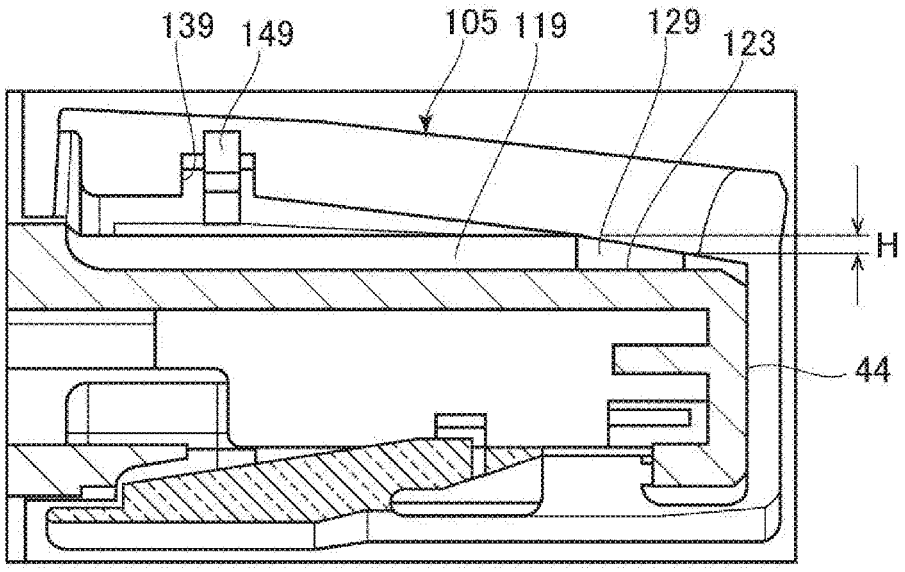
FIG. 23 is a longitudinally sectional view of the side retainer which is being moved.

Here, on the front side opposite to the notch 139, the partition 119 is partially absent. Therefore, the lifting height of the retainer protrusion 117 required for moving the side retainer 25 from the formal locking groove 121 to the temporary locking groove 123 is lower on the front side than in a central portion, so that the front end of the retainer protrusion 117 can move more easily on the groove bottom side (lower) of the temporary locking groove 123 than on the free end side thereof when the side retainer 25 is moved from the formal locking groove 121 to the temporary locking groove 123. For example, when the retainer protrusion 117 gets over the partition 119 at the lowest position as shown in FIG. 23, a difference H occurs between the upper end of the temporary locking groove 123 and the front end of the retainer protrusion 117 so that the retainer protrusion 117 can move from the formal locking position if the front end of the retainer protrusion 117 moves at a position lower than the upper end of the temporary locking groove 123. Accordingly, when the side retainer 25 is moved from the formal locking groove to the temporary locking groove, the front side of the retainer protrusion 117 hardly passes through the temporary locking groove 123, so that the side retainer 25 can be suppressed from dropping off from the inner housing front portion 44 due to unintentional release from locking.

Incidentally, the present invention is not limited to the aforementioned embodiment, but various modifications can be used within the scope of the present invention. For example, the present invention is not limited to the aforementioned embodiment, but modifications, improvements, etc. can be made suitably. In addition thereto, materials, shapes, numbers, arrangement places, etc. of constituent elements in the aforementioned embodiment are not limited, but any materials, any shapes, any numbers, any arrangement places, etc. may be used as long as the present invention can be attained.

For example, although the example of the CPA upper arm 91 in which the upper locking claw 93 is locked to the upper locking protrusion 33 through the locking piece 55 of the housing arm 51 was described in the aforementioned embodiment, the present invention is not limited to the example. For example, the locking piece 55 and the upper locking claw 93 may be configured to be locked to different locking faces from each other.

Here, the features of the aforementioned embodiment of the connector 11 and the female connector unit 12 according to the present invention will be summarized and listed briefly in the following paragraphs [1] to [7].

[1] A connector (11) comprising:

a first housing (13);

a second housing (15) fitted to the first housing (13); and a fitting assuring member (21) slidably attached to an outside of the first housing (13), the second housing (15) including a first locking protrusion portion (33) having a first slope (35), the fitting assuring member (21) including a first assuring locking portion (93) sliding on the first slope (35) to be elastically deformed in accordance with relative movement to the second housing (15), the first assuring locking portion (93) being configured to slide and move relatively to the first housing (13) to get over the first locking protrusion portion (33) and be elastically restored to be locked to the first locking protrusion upon the first housing (13) and the second housing (15) being fitted to each other, the first assuring locking portion (93) beginning to slide on the first slope (35) before completion of the fitting between the first housing (13) and the second housing (15), the first assuring locking portion (93) staying on the first slope (35) until the completion of the fitting between the first housing (13) and the second housing (15).

[2] The connector (11) according to the item [1], wherein the first housing (13) includes a connector locking portion (55) sliding on the first slope (35) to be elastically deformed in accordance with relative movement to the second housing (15), the connector locking portion (55) is configured to get over the first locking protrusion portion (33) and be elastically restored to be locked to the first locking protrusion portion (33), the first housing (13) and the second housing (15) are brought into a connector (11) fitting state in which the first housing (13) and the second housing (15) are completely fitted to each other when the connector locking portion (55) is locked to the first locking protrusion portion (33), the first assuring locking portion (93) begins to slide on the first slope (35) while the connector locking portion (55) stays on the first slope (35), and in the connector (11) fitting state the first assuring locking portion (93) gets over the first locking protrusion portion (33) and the connector locking portion (55) and is elastically restored and locked to the connector locking portion (55) locked to the first locking protrusion portion (33).

[3] The connector (11) according to the item [2], wherein the second housing (15) includes a second locking protrusion portion (34) in a different position from the first locking protrusion portion (33), the second locking protrusion portion (34) has a second slope (36);

the fitting assuring member (21) includes a second assuring locking portion (101) sliding on the second slope (36) to be elastically deformed in accordance with relative movement to the second housing (15), the second assuring locking portion (101) is configured to slide and move relatively to the first housing (13) in the connector (11) fitting state to get over the second locking protrusion portion (34) and be elastically restored to be locked to the second locking protrusion, the second assuring locking portion (101) begins to slide on the second slope (36) while the connector locking portion (55) stays on the first slope (35), the second assuring locking portion (101) stays on the second slope (36) until the first housing (13) and the second housing (15) are brought into the connector (11) fitting state.

[4] The connector (11) according to the item [2] or the item [3], wherein the first housing (13) includes a locking covering portion (61) in a position where the connector locking portion (55) is allowed to be elastically deformed by the first slope (35), the locking covering portion (61) covers an outside of the connector locking portion (55).

[5] The connector (11) according to any one of the item [1] to the item [4], wherein the first housing (13) includes a looseness preventing piece (65) supported to the first housing (13) and having a cantilevered-shape;

the second housing (15) includes a preventing piece regulating portion (29) inserted inside the looseness preventing piece (65) to regulate inward displacement of the looseness preventing piece (65) when the completion of the fitting between the first housing (13) and the second housing (15), the fitting assuring member (21) includes a preventing piece pressing portion (143) holding the looseness preventing piece (65) between the preventing piece pressing portion (143) and the preventing piece regulating portion (29) while pressing the looseness preventing piece (65) inward in accordance with sliding movement of the fitting assuring member (21) relative to the first housing (13), the sliding movement of the fitting assuring member (21) to a position where the preventing piece pressing portion (143) presses the looseness preventing piece (65) is allowed in the connector (11) fitting state.

[6] The connector (11) according to any one of the item [1] to the item [5], further comprising:

a retainer attached to an outside of the first housing (13), wherein the first housing (13) includes a locking groove group (125) including a formal locking groove (121) and a temporary locking groove (123) sandwiching a partition (119), the partition (119) is partially absent or lower in height than a central portion of the partition (119) on one end side of the locking groove group (125), the retainer includes a straight-line-shaped retainer protrusion (117) selectively entering the formal locking groove (121) or the temporary locking groove (123) to engage with the locking groove group (125), the retainer protrusion (117) is configured to get over the partition (119) to move between the formal locking groove (121) and the temporary locking groove (123) by a bend of the retainer.

[7] A connector unit (12) comprising:

a first housing (13) fitting to a second housing (15) having a locking protrusion portion (33) including a slope (35); and a fitting assuring member slidably attached to an outside of the first housing (13), the fitting assuring member including an assuring locking portion (93) sliding on the slope (35) to be elastically deformed in accordance with relative movement to the second housing (15), the assuring locking portion (93) being configured to slide and move relatively to the first housing (13) to get over the locking protrusion portion (33) and be elastically restored to be locked to the locking protrusion portion (33) upon the first housing (13) and the second housing (15) being fitted to each other, the assuring locking portion (93) beginning to slide on the slope (35) before completion of the fitting between the first housing (13) and the second housing (15), the assuring locking portion (93) staying on the slope (35) until the completion of the fitting between the first housing (13) and the second housing (15).

A connector and a connector unit according to the present invention can make a repulsive force surely act until just before fitting, so that half-fitting can be prevented. The present invention having this effect can be, for example, used for a connector structure with a fitting assuring member (CPA).

REFERENCE SIGNS LIST

11 connector
12 female connector unit (connector unit)
13 female housing (first housing)
15 male housing (second housing)
17 female terminal (first terminal)
19 male terminal (second terminal)
21 CPA (fitting assuring member)
25 side retainer (retainer)
29 hood portion (preventing piece regulating portion)
33 upper locking protrusion (first locking protrusion portion, locking protrusion portion)
34 lower locking protrusion (second locking protrusion portion)
35 upper slope (first slope, slope)
36 lower slope (second slope)
37 upper flat face
38 lower flat face
44 inner housing front portion
51 housing arm
53 elastic arm piece
55 locking piece (connector locking portion)
61 female housing bridge (locking covering portion)
65 side lock (looseness preventing piece)
91 CPA upper arm
93 upper locking claw (first assuring locking portion, assuring locking portion)
99 CPA lower arm
101 lower locking claw (second assuring locking portion)
117 retainer protrusion
119 partition
121 formal locking groove
123 temporary locking groove
125 locking groove group
143 guide face (preventing piece pressing portion)

The invention claimed is:

1. A connector comprising:

a first housing;

a second housing fitted to the first housing; and a fitting assuring member slidably attached to an outside of the first housing, the second housing including a first locking protrusion portion having a first slope with a protruding height that increases toward a rear fitting direction and an upper flat face extending from the first slope, the first housing includes a connector locking portion sliding on the first slope to be elastically deformed in accordance with relative movement to the second housing, the connector locking portion is configured to get over the first locking protrusion portion and be elastically restored to be locked to the first locking protrusion portion, the fitting assuring member including a first assuring locking portion sliding on the first slope to be elastically deformed in accordance with relative movement to the second housing, the first assuring locking portion being configured to slide and move relatively to the first housing to get over the first locking protrusion portion and be elastically restored to be locked to the first locking protrusion upon the first housing and the second housing being fitted to each other, the first assuring locking portion beginning to slide on the first slope before completion of the fitting between the first housing and the second housing, the first assuring locking portion staying on the first slope until the completion of the fitting between the first housing and the second housing such that, when the connector locking portion locks to the first locking protrusion portion, the first assuring locking portion is on the first slope and spaced away from the upper flat face.

2. The connector according to claim 1, wherein the first housing and the second housing are brought into a connector fitting state in which the first housing and the second housing are completely fitted to each other when the connector locking portion is locked to the first locking protrusion portion, the first assuring locking portion begins to slide on the first slope while the connector locking portion stays on the first slope, and in the connector fitting state the first assuring locking portion gets over the first locking protrusion portion and the connector locking portion and is elastically restored and locked to the connector locking portion locked to the first locking protrusion portion.

3. The connector according to claim 2, wherein the second housing includes a second locking protrusion portion in a different position from the first locking protrusion portion, the second locking protrusion portion has a second slope, the fitting assuring member includes a second assuring locking portion sliding on the second slope to be elastically deformed in accordance with relative movement to the second housing, the second assuring locking portion is configured to slide and move relatively to the first housing in the connector fitting state to get over the second locking protrusion portion and be elastically restored to be locked to the second locking protrusion, the second assuring locking portion begins to slide on the second slope while the connector locking portion stays on the first slope, the second assuring locking portion stays on the second slope until the first housing and the second housing are brought into the connector fitting state.

4. The connector according to claim 2, wherein the first housing includes a locking covering portion in a position where the connector locking portion is allowed to be elastically deformed by the first slope, the locking covering portion covers an outside of the connector locking portion.

5. The connector according to claim 1, wherein the first housing includes a looseness preventing piece supported to the first housing and having a cantilevered-shape;

the second housing includes a preventing piece regulating portion inserted inside the looseness preventing piece to regulate inward displacement of the looseness preventing piece when the completion of the fitting between the first housing and the second housing, the fitting assuring member includes a preventing piece pressing portion holding the looseness preventing piece between the preventing piece pressing portion and the preventing piece regulating portion while pressing the looseness preventing piece inward in accordance with sliding movement of the fitting assuring member relative to the first housing, the sliding movement of the fitting assuring member to a position where the preventing piece pressing portion presses the looseness preventing piece is allowed in the connector fitting state.

6. The connector according to claim 1, further comprising:

a retainer attached to an outside of the first housing, wherein the first housing includes a locking groove group including a formal locking groove and a temporary locking groove sandwiching a partition, the partition is partially absent or lower in height than a central portion of the partition on one end side of the locking groove group, the retainer includes a straight-line-shaped retainer protrusion selectively entering the formal locking groove or the temporary locking groove to engage with the locking groove group, the retainer protrusion is configured to get over the partition to move between the formal locking groove and the temporary locking groove by a bend of the retainer.

7. A connector unit comprising:

a first housing having a connector locking portion fitting to a second housing having a locking protrusion portion including a slope with a protruding height that increases toward a rear fitting direction and an upper flat face extending from the slope; and a fitting assuring member slidably attached to an outside of the first housing, the connector locking portion sliding on the slope to be elastically deformed in accordance with relative movement to the second housing, the connector locking portion is configured to get over the locking protrusion portion and be elastically restored to be locked to the locking protrusion portion, the fitting assuring member including an assuring locking portion sliding on the slope to be elastically deformed in accordance with relative movement to the second housing, the assuring locking portion being configured to slide and move relatively to the first housing to get over the locking protrusion portion and be elastically restored to be locked to the locking protrusion portion upon the first housing and the second housing being fitted to each other, the assuring locking portion beginning to slide on the slope before completion of the fitting between the first housing and the second housing, the assuring locking portion staying on the slope until the completion of the fitting between the first housing and the second housing such that, when the connector locking portion locks to the locking protrusion portion, the assuring locking portion is on the slope and spaced away from the upper flat face.

* * * * *